US006001007A

United States Patent [19]

Maeda et al.

[11] Patent Number: 6,001,007

[45] Date of Patent: Dec. 14, 1999

[54] TEMPLATE USED FOR POLISHING A SEMICONDUCTOR WAFER

[75] Inventors: Masahiko Maeda; Yuichi Nakayoshi, both of Kanagawa, Japan

[73] Assignee: Komatsu Electronic Metals Co., Ltd., Kanagawa, Japan

[21] Appl. No.: 08/866,017

[22] Filed: May 30, 1997

[30] Foreign Application Priority Data

May 31, 1996 [JP] Japan ..... 8-175345

[51] Int. Cl.[6] ..... B24B 37/00

[52] U.S. Cl. ..... 451/398; 451/63; 451/288

[58] Field of Search ..... 451/41, 63, 285, 451/286, 287, 288, 289, 290, 398

[56] References Cited

U.S. PATENT DOCUMENTS 5,267,418 12/1993 Currie et al. .

5,398,459 3/1995 Okumura et al. .

5,573,448 11/1996 Nakazima et al. .

5,645,474 7/1997 Kubo et al. .

*Primary Examiner*—Timothy V. Eley

*Attorney, Agent, or Firm*—Sughrue, Mion, Zinn, Macpeak & Seas, PLLC

[57] ABSTRACT

A backing pad 7 is secured on the bottom of a ceramic plate 6. A template 1 is secured on the bottom of the backing pad 7. The thickness of the template 1 successively diminishes from the inner periphery wall 12 of the central accommodation opening for restraining the semiconductor wafer, toward the outer periphery wall 13 of the template 1, so that the bottom of the template 1 is inclined and the cross section of the template 1 is tapered.

4 Claims, 3 Drawing Sheets

TEMPLATE USED FOR POLISHING A SEMICONDUCTOR WAFER

BACKGROUND OF THE INVENTION

1. Field of the Invention

The present invention relates to a method of polishing a semiconductor wafer retained by a template and to templates used in the polishing operation.

2. Description of Prior Art

As shown in FIG. 4, in the operation of polishing a semiconductor wafer 10 which is restrained within a template 8 and is impelled in to contact with an abrasive cloth 5, there exists a clearance 9 between the bottom surface of the template 8 and the upper surface of the abrasive cloth 5 due to the width difference between the template 8 and the semiconductor wafer 10. Therefore, the stresses induced on the upper surface of the abrasive cloth 5 vary abruptly within the region which takes the contact point 81 of the template 8 and the semiconductor wafer 10 as its center. For this reason, deflection 51*a* appears on the upper surface of the abrasive cloth 5, and this will cause inadequate contact between the outer peripheral portion 10*a* of the semiconductor wafer 10 and the outer contact surface 51 of the abrasive cloth 5. Accordingly, it is very difficult to polish the outer peripheral portion 10*a* of the semiconductor wafer 10. As a result, as shown in FIG. 5, the central portion of the polished surface of the semiconductor wafer 10 will become depressed, and the flatness of the semiconductor wafer 10 will be impaired after polishing.

SUMMARY OF THE INVENTION

In view of the above-described defects, the object of the present invention provides a method of polishing semiconductor wafers and provides a template used in the polishing operation, by which deflection (induced by the contact with the semiconductor) of the contact surface of the abrasive cloth can be prevented, and semiconductor wafers can be polished to a high degree of flatness.

According to this invention, in the procedure of impelling an abrasive cloth in to contact with a semiconductor wafer restrained by a template to effect polishing, the template can prevent deflection of the contact surface (contact with the outer peripheral portion of the semiconductor wafer) of the abrasive cloth. Therefore semiconductor wafer can be polished to a high degree of flatness.

Furthermore, the template has a central accommodation opening for restraining the semiconductor wafer, and the thickness of the template successively diminishes from the inner periphery wall of the central accommodation opening toward the outer periphery wall of the template; that is to say, the cross section of peripheral portion the template is tapered shape.

Furthermore, the bottom surface of template used for restraining the semiconductor wafer is convex shaped.

Furthermore, the angle between the bottom surface and the outer peripheral wall of the template used for restraining the semiconductor wafer is chamfered.

According to this invention, in the waxless procedure of polishing a semiconductor wafer restrained by a template, deflection on the contact surface of an abrasive cloth, incurred by the contacting of the outer peripheral portion of the semiconductor wafer, can be prevented, and semiconductor wafers of a high degree of flatness can thus be obtained by uniform polishing. Templates which can prevent the above deflection are depicted in the following embodiments.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Embodiment One

Figure 1:
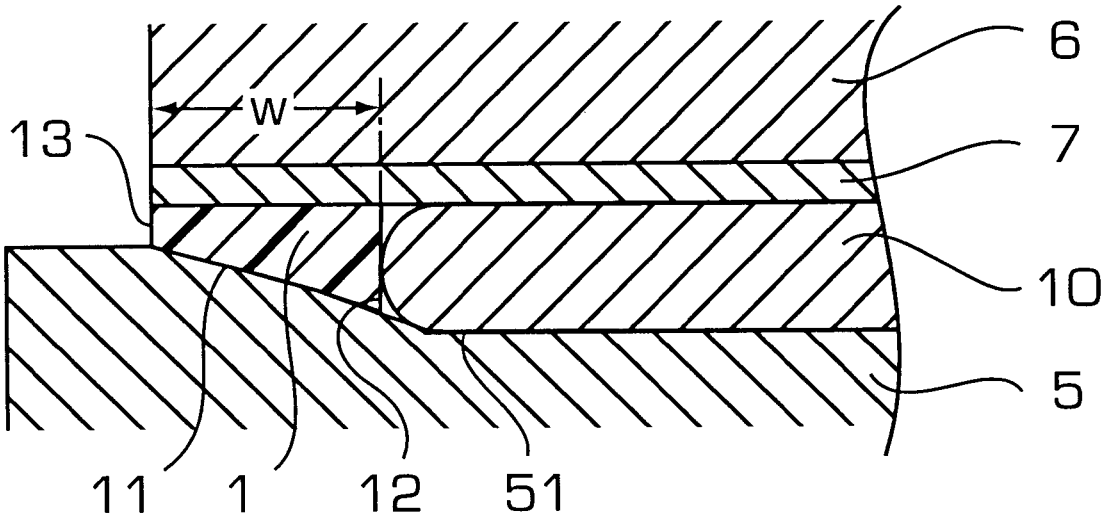
FIG. 1 is a schematic side cross-sectional view showing the method of polishing semiconductor wafers according to this invention, in which a template of embodiment 1 is used.

FIG. 1 is a schematic side cross-sectional view showing the method of polishing a semiconductor wafer according to this invention, in which a template of Embodiment 1 is used.

As shown in FIG. 1, in the top ring portion of embodiment 1, a backing pad 7 is secured on the bottom of a ceramic plate 6, and a template 1 is secured on the bottom of the backing pad 7. The cross section of the template 1 is tapered. The thickness of the template successively diminishes from the inner periphery wall 12 of the central accommodation opening for restraining the semiconductor wafer, toward the outer periphery wall 13 of the template, so that the bottom of the template is inclined.

By such an arrangement, the abrasive cloth 5 contacting with the template 1 slides along the inclined bottom of the template 1, and no deflection will occur on the surface 51, with which the semiconductor wafer 10 is in contact. Therefore, the contact surfaces of the semiconductor wafer 10 and the abrasive cloth 5 become uniform, and the semiconductor wafers can be polished flat.

Furthermore, as for the inclination of the bottom surface of the template, the width W is taken to be 20 mm when an eight-inch semiconductor wafer is undergoing polishing. Under such a circumstance, it is preferable to make the thickness of the inner periphery wall 12 of the central accommodation opening for restraining the semiconductor wafer about 0.7 mm–0.75 mm and the thickness of the outer periphery wall 13 of the template, about 0.2 mm–0.6 mm.

Embodiment Two

Figure 2:
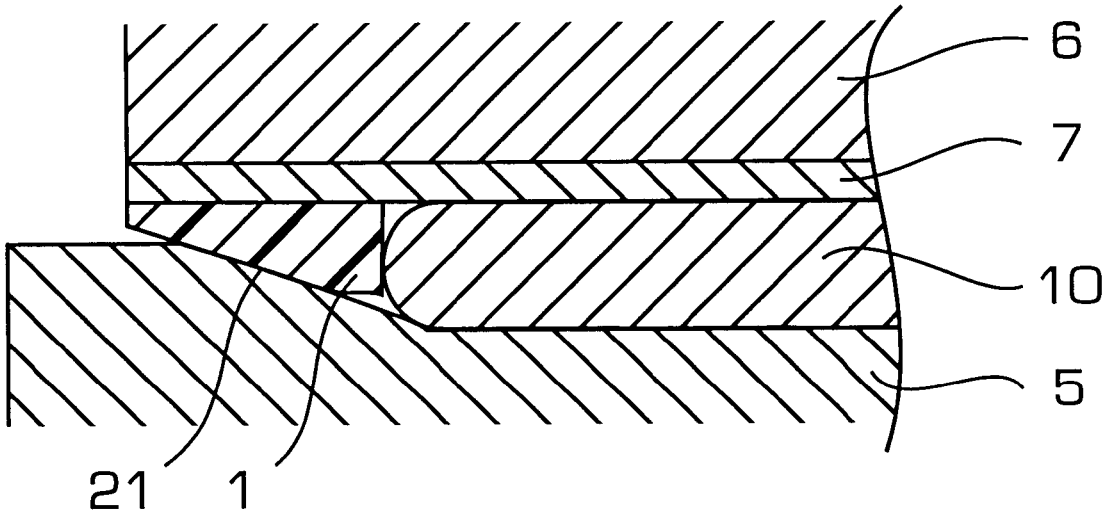
FIG. 2 is a schematic side cross-sectional view showing the method of polishing semiconductor wafers according to this invention, in which a template of embodiment 2 is used.

FIG. 2 is a schematic side cross-sectional view showing the method of polishing a semiconductor wafer according to this invention, in which a template of Embodiment 2 is used.

In Embodiment 1, the whole bottom surface 11 of the template 1 is made inclined, however, as shown in FIG. 2, in Embodiment 2, only part of the bottom surface 21 of the template 2 is made inclined. By such an arrangement, same as in Embodiment 1, the abrasive cloth 5 slides along the inclined surface 21. This prevents deflection of the contact surface of the abrasive cloth 5, with which the semiconductor wafer 10 is in contact.

Embodiment Three

Figure 3:
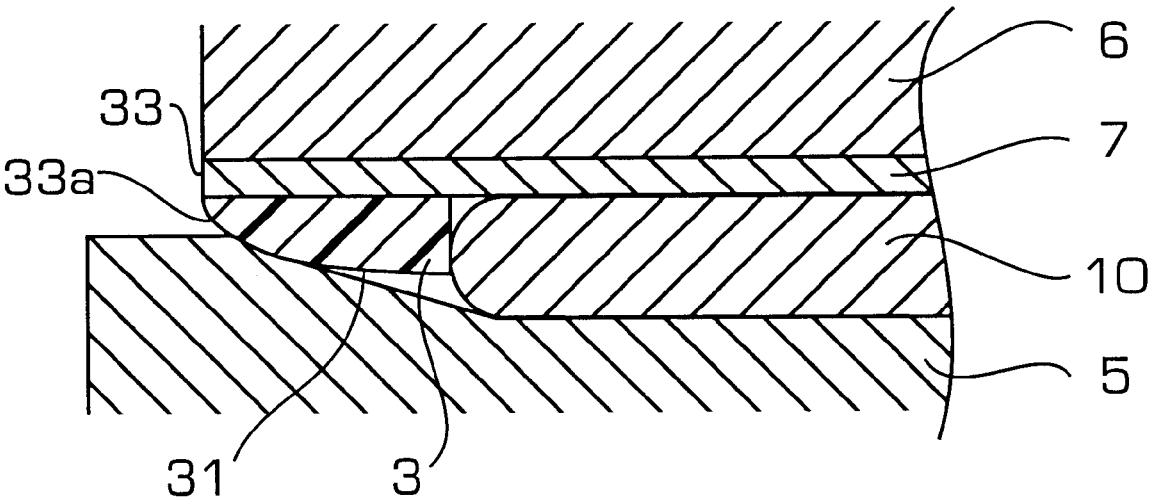
FIG. 3 is a schematic side cross-sectional view showing the method of polishing semiconductor wafers according to this invention, in which a template of embodiment 3 is used.
Figure 4:
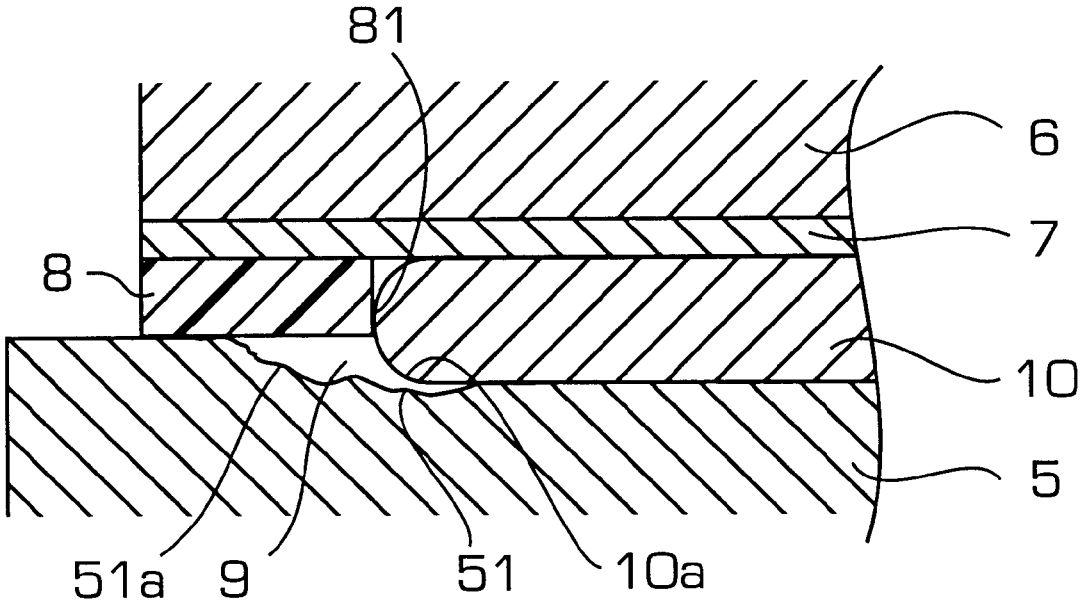
FIG. 4 is a schematic side cross-sectional view showing a conventional method of polishing semiconductor wafers.
Figure 5:
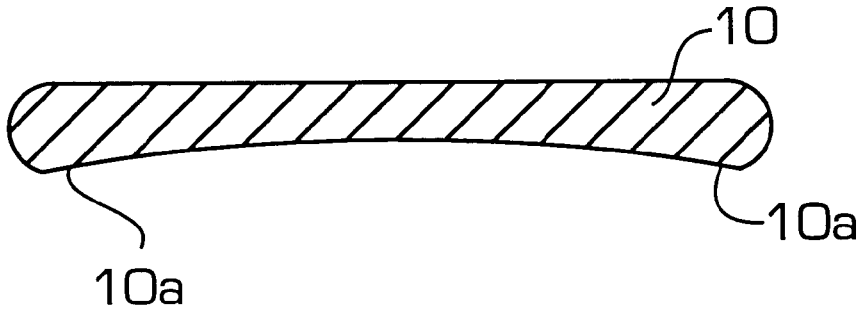
FIG. 5 is a side cross-sectional view showing the contour of a semiconductor wafer polished by the conventional method.

FIG. 3 is a schematic side cross-sectional view showing the method of polishing a semiconductor wafer according to this invention, in which a template of Embodiment 3 is used.

As shown in FIG. 3, in Embodiment 3, the bottom surface 31 of the template 3 is made curved and inclined. In addition, the angle 33*a* between the bottom surface 31 and the outer peripheral surface 33 is chamfered and made smooth so as to keep the abrasive cloth 5 from touching the corner and to direct the abrasive cloth 5 to slide along the bottom surface smoothly. This prevents deflection of the contact surface of the abrasive cloth 5, with which the semiconductor wafer 10 is in contact.

Due to the fact that this invention is constructed as the above-described, the contact between the outer peripheral portion of the semiconductor wafer and the abrasive cloth is more definite and a uniform degree of polishing can be obtained. Accordingly, a high degree of flatness can be achieved.

What is claimed is:

1. A template for polishing a semiconductor wafer secured to a plate, comprising:

a member having a central opening defined by an inner surface for accommodating said wafer therein, said member having an outer surface and upper and lower surfaces with said upper surface being contacted by said plate and said lower surface being contacted by a polishing cloth during polishing of said wafer, wherein at least a portion of said lower surface is tapered such that the thickness of said member from said upper surface to said lower surface decreases in an outer direction extending from said inner surface to said outer surface.

2. The template of claim 1, wherein said portion of said lower surface is rounded.

3. The template of claim 1, wherein a corner defined by an intersection of said lower surface and said outer surface is chamfered.

4. The template of claim 1, wherein the entire lower surface is tapered.

* * * * *